US005820817A

United States Patent [19]

Angeliu et al.

[11] Patent Number: 5,820,817

[45] Date of Patent: Oct. 13, 1998

[54] STEEL ALLOY

[75] Inventors: Thomas Martin Angeliu, Clifton Park, N.Y.; Clyde Leonard Briant, Barrington, R.I.; Charles Gitahi Mukira, Watervliet, N.Y.

[73] Assignee: General Electric Company, Schenectady, N.Y.

[21] Appl. No.: 901,844

[22] Filed: Jul. 28, 1997

[51] Int. Cl.[6] ..... C22C 38/30; C22C 38/52

[52] U.S. Cl. ..... 420/40; 420/64; 420/69

[58] Field of Search ..... 420/40, 64, 69

[56] References Cited

U.S. PATENT DOCUMENTS

| | | | |
|---|---|---|---|
| 4,564,392 | 1/1986 | Ohhashi et al. | 420/64 |
| 5,320,687 | 6/1994 | Kipphut et al. | 420/69 |

FOREIGN PATENT DOCUMENTS

| | | |
|---|---|---|
| 55-2775 | 1/1980 | Japan . |
| 62-170461 | 7/1987 | Japan . |
| 472039 | 3/1992 | Japan . |
| 726351 | 1/1995 | Japan . |
| 103447 | 11/1995 | Japan . |

OTHER PUBLICATIONS

"Additive Remedy for Temper Brittleness," M.P. Seah et al., Metal Science, May 1979, pp. 307–314.

"Grain Boundary Segregation of Ce, Mo and P and Temper Embrittlement of Steel," W. Chengjian et al., vol. 26, No. 12, Dec. 1991, pp. 29–35.

"Solubility of Phosphorus in a and r–Iron," H. Kaneko et al., Journal of the Japan Institute of Metals, vol. 29, 1965, pp. 166–170.

"Thermal Ageing Studies of 9%Cr 1%Mo Steel," M. Wall et al., Metallurgy Division, AERE Harwell, Didcot, Oxon, UK, Jan. 1984.

"Transmission Electron Microscope and Scanning Auger Investigations of Temper–Embrittled 12% Cr Steel," S. Mandziej et al., Fresenius Z Anal Chenm (1987) 329 pp. 335–341.

"Heat Treatment, Ageing Effects and Microstructure of 12% Cr Steels," J.W. Schinkel et al., ASM International Conference, American Society for Metals, 1983, pp. 131–149.

"The Effect of Sulphur on the Temper Embrittlement Susceptibility of a Rare Earth—Containing Low Alloy Steel," W. Barrett et al., Dept. of Metallurgy & Materials Eng., Univ. of the Witwatersrand, Johannesburg, South Africa, 1987, Pergamon Journals of Ltd, vol. 21, pp. 123–128.

*Primary Examiner*—Deborah Yee

*Attorney, Agent, or Firm*—Ernest G. Cusick; Noreen C. Johnson

[57] ABSTRACT

A stainless steel comprises additives including at least one of rare earth elements and boron, so as to exhibit resistance to long term aging embrittlement. The stainless steel also contains balanced amounts of nickel and cobalt to minimize a ration of nickel to cobalt and optimize aging embrittlement resistance with as tempered toughness. The remainder of the stainless steel comprising, by weight percentage:

| | |
|---|---|
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as Nickel, Cobalt, Manganese and Copper | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance. |

53 Claims, 2 Drawing Sheets

STEEL ALLOY

FIELD OF THE INVENTION

The invention relates generally to stainless steel alloys. In particular, the invention is directed to stainless steel alloys with alloy constituents that improve many characteristics and properties of the alloy, including corrosion resistance, creep strength, yield strength, tensile strength and long term aging embrittlement resistance.

BACKGROUND OF THE INVENTION

Stainless steels having excellent strength, low brittle to ductile transition temperature and good hardening characteristics in thick sections have long been used as gas turbine wheel materials. They are, however, often subject to embrittlement on exposure to elevated temperatures. The embrittlement is due, at least in part, to formation of detrimental phases within the alloy grains (irreversible embrittlement) or to segregation of some harmful elements to the grain boundaries (reversible embrittlement).

In attempts to overcome this problem, carbide formers, such as tungsten, molybdenum, and other strong carbide formers have been added in an attempt to limit a tendency toward irreversible embrittlement. While some success has been gained, reversible embrittlement problems remain, since heat treatments to relieve the condition may degrade desired properties and dimensional integrity of the stainless steel.

Several steel compositions have been developed to provide a high alloy steel with reduced embrittlement characteristics. However, they have not been able to maintain the desired properties of a high alloy steel. For example, Japanese application Nos. 7-26351 and 62-170461 contains high levels of manganese, which promotes undesirable embrittlement in a high alloy steel. Further, Japanese application No. 55-2775 contains high levels of manganese, which promotes undesirable embrittlement in a high alloy steel, and high levels of nickel, which undesirably reduces long creep strength. Thus, the related art is deficient in its attempts to maintain desirable effects of high alloy steels, and reducing embrittlement issues.

A martensitic stainless steel alloy disclosed in U.S. Pat. No. 5,320,687 to Kipphut et al., the entire contents of which are fully incorporated herein by reference, exhibits desirable properties of stainless steels. The Kipphut martensitic stainless steel alloy provides enhanced resistance to embrittlement. The Kipphut stainless steel martensitic alloy does not impose undesirable mechanical or corrosion resistant property penalties.

Fe—12Cr stainless steels (hereinafter Fe—12Cr steels) are known in the art, and possess desirable characteristics for use in various high temperature articles. For example, these articles may be employed in used at high temperatures, and may be subjected to thermal aging.

Fe—12Cr steels may experience a decrease in fracture toughness, for example when tempered in a range between about 800 to about 1000° F. (425° /540° C.). This decrease is evident in the graphs of FIG. 1, which illustrates an effect of tempering temperature and alloying on an impact trough of Fe—12Cr steels.

The decrease in fracture toughness may also occur when Fe—12Cr steels are heated to temperatures higher than about 1000° F. (593° C.), and then aged at lower temperatures. This is illustrated in FIG. 2, which compares fracture appearance transition temperature (FATT) temperatures of a M152 stainless steel composition, aged at various temperatures and times, with and without a subsequent de-embrittlement treatment, for example at about 1100° F. (593° C.)/2hr.

The source of decrease in fracture toughness is not exactly known. However, it is possible that a decrease in fracture toughness is generally attributable to at least one of grain boundary impurity segregation and precipitation of second phases.

SUMMARY OF THE INVENTION

Accordingly, it is desirable to provide a steel alloy composition that overcomes the above, and other, undesirable effects that may occur in known steel compositions.

It is also desirable to provide stainless steel alloys with alloy constituents that improve many characteristics and properties of the alloy, including corrosion resistance, creep strength, yield strength, tensile strength and long term aging embrittlement resistance and to prevent a decrease in fracture toughness, in particular in high alloy steels.

It is therefore desirable to provide a high alloy steel composition that comprises additives including at least one of rare earth elements and boron. The weight percentage of the rare earth elements is about 0.50 max, and the weight percentage of the boron is in a range of about 0.001 to about 0.03. The remainder of the high alloy steel comprises, by weight percentage:

| | |
|---|---|
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as Ni, Co, Mn, Cu | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance. |

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE PREFERRED EMBODIMENTS

Figure 1:
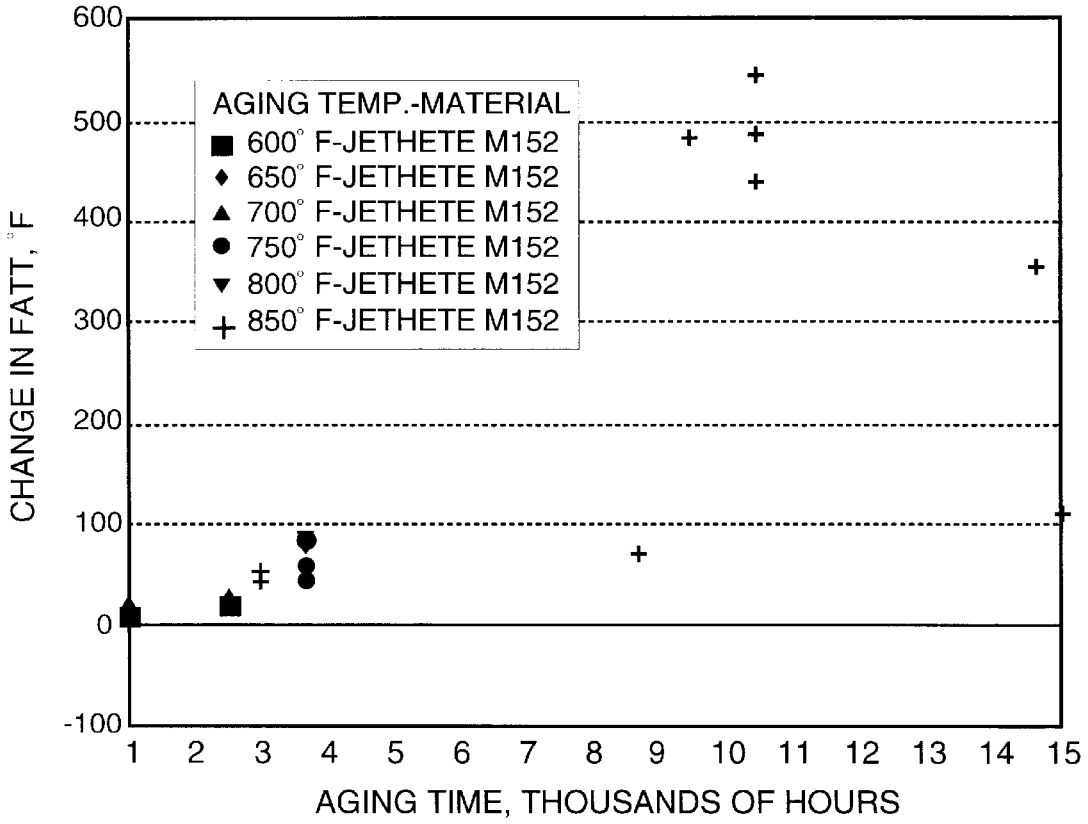
FIG. 1 is a chart on which fracture appearance transition temperature (FATT) is plotted against aging time.
Figure 2:
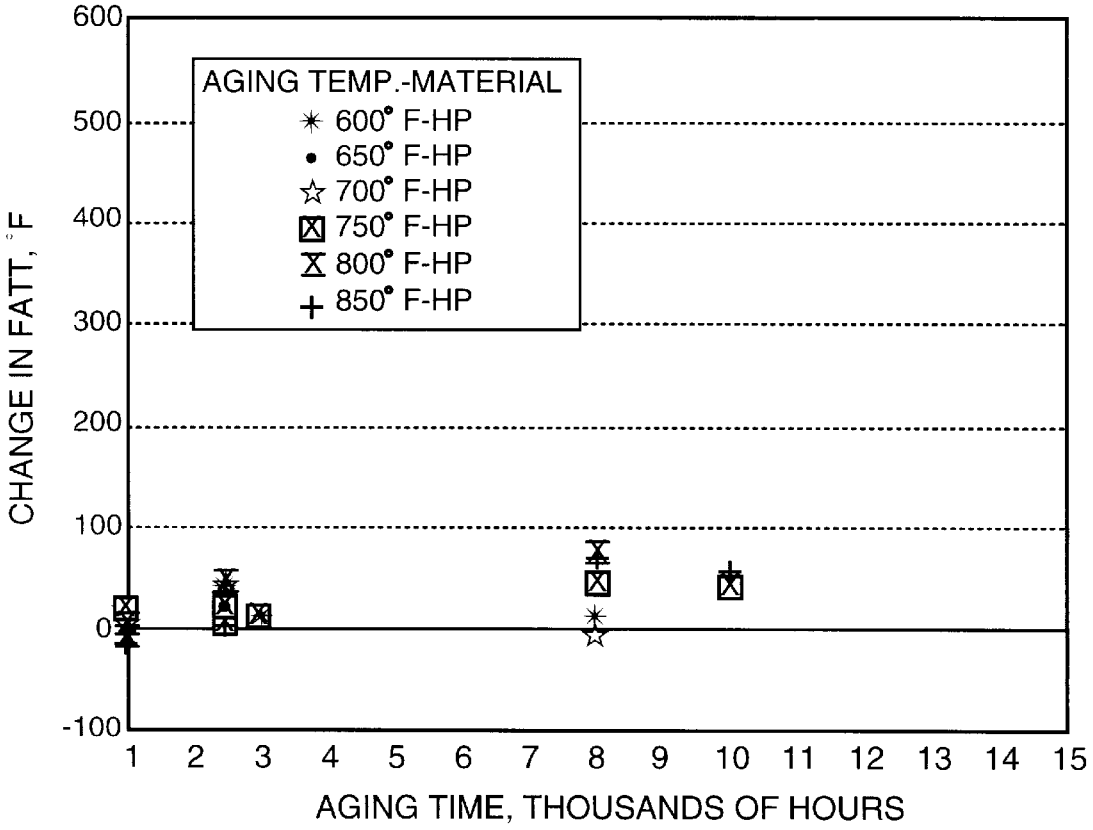
FIG. 2 is a chart similar to FIG. 1 showing aging time data.

High alloy steels, such as but not limited to Fe—12Cr stainless steels (hereinafter Fe—12Cr steels), are known in the art. The high alloy steels possess desirable characteristics for use in various engineering articles. For example, these engineering articles may be employed in used at high temperatures, and may be subjected to thermal aging.

A wide variety of iron-based stainless steel alloys are susceptible to at least one of, and possibly both of, long term aging embrittlement and a decrease in the fracture toughness upon thermal aging. In low alloy steels, for example those alloyed steels with relatively low amounts of alloying constituents, this long term aging embrittlement is most probably associated with segregation of impurities, in particular phosphorous to grain boundaries.

However, in more high alloy steels, for example those alloyed steels with relatively high amounts of alloying constituents, including but not limited to Fe—12Cr steels, long term aging embrittlement is well documented, but its causes are not well understood. The long term aging embrittlement in high alloy steels has been studied, and may be attributed to at least one of grain boundary impurity segregation and precipitation of second phases, such as for example, carbides and Laves phases, however this is merely theoretical.

For example, a detailed study of Fe—9Cr-1 Mo steel was conducted by M. Wall et al., "Thermal Aging Studies of 9% Cr 1% Mo Steel," *International Atomic Energy Agency International Working Group on Fast Reactors Specialist Meeting on "Mechanical Properties of Structural Materials Including Environmental Effects,"* Chester, (Oct. 10–, 1983). It concluded that degradation in fracture toughness upon aging at 500° to 550° C. for 10 Khr was consistent with both grain boundary segregation and microstructural changes. Nucleation and growth of carbides and Laves phases, were believed to result in degradation in fracture toughness upon aging at 500° to 550° C. for 10 Khr.

High alloyed steels, such as Fe—12Cr steels and its alloys, have been studied, with particular attention to the characterization of precipitates as a function of thermal aging. For example, Schinkel et al., "Heat Treatment, Aging Effects and Microstructure of 12% Cr Steels," *Ferritic Steels for High-Temperature Applications*, ASM, Metals Park, Ohio (1982); Berger et al., "Development of High Strength 9–12% CrMoV Steels for High Temperature Rotor Forgings, "11th *International Forgemasters Meeting*, Terni/Spoleto, Italy, (Jun. 1991); Mandziej et al., "Transmission Electron Microscope and Scanning Auger Investigations of Temper-Embrittled 12% Cr Steel," *Fresenius Z Anal Chem.*, Vol. 329 (1987); and Goretzki et al., "Small Area MXPS- and TEM-Measurements on Temper-Embrittled 12% Cr Steel," *Fresenius Z Anal Chem.*, Vol. 333 (1989), relate precipitates in Fe—12Cr steels and its alloys, as a function of thermal aging.

While most of the above research focused on relatively short tempering times, for example tempering times up to about 100 hours, Schinkel reported on Fe—11 Cr with 0.2% C, 1 .0% Mo and 0.3% V aged up to 30 Khrs at 500° C. and 550° C. At 500° C., a carbide film was observed to cover nearly all of the martensitic lath boundaries. At 550° C., pronounced growth of carbides was reported to be located on prior austenitic grain boundaries. By correlating carbide density and impact toughness, Schenkel concluded that carbides were responsible for the decrease in toughness with aging. However, Schenkel did not study the effects of impurity segregants.

Aging at higher temperatures for relatively long times, such as at about 600° C. for 10 Khr, embrittlement of high alloy steels has been attributed to formation of a Laves intermetallic phase. Berger reported that formation of Laves appears most rapidly at 600° C. Berger also reported that formation of Laves may be accelerated by a presence of high levels of N and W. Therefore, segregation of impurities is at least partially responsible for degradation of toughness in high alloy steels, such as Fe—12Cr steels, in addition to grain boundary precipitation. At short tempering times, for example less than about 100 hrs, temper-embrittled high alloy steels exhibit increased concentrations of phosphorous (P) on fracture surfaces. Segregated phosphorous also has a linear relationship with impact transition temperatures of Fe—12Cr steels, when Fe—12Cr steels are tempered between about 500° and 600° C. for up to about 250hrs.

Accordingly, the segregation of phosphorous, among other elements, such as but not limited to Sn, Sb, and As, is believed to be a large factor in the long term aging embrittlement of high alloy steels, such as Fe—12Cr steels. Therefore, as embodied in the invention, it is desirable to add at least one constituent to reduce the long term aging embrittlement of high alloy steels, preferably by reducing the segregation of phosphorous.

Additions of molybdenum (Mo) to high alloy steels improve resistance to temper-embrittlement. Mandziej reported that resistance to long term aging embrittlement is possibly improved by scavenging phosphorous in a metal matrix. However, effectiveness of molybdenum is decreased when the material is aged, where molybdenum leaves a solid solution that becomes incorporated as undesirable toughness reducing carbides.

The addition of elements, other than molybdenum, to act as phosphorous scavengers, has been explored. In general, elements that decrease the solubility of phosphorous in iron appear to be satisfactory phosphorous scavengers. For example, Kaneko et al., "Solubility of Phosphorous in alpha and gamma-Iron," *J. of the Japan Institute of Metals*, Vol. 29 (1965) studied effects of alloying additions on decreasing solubility of phosphorous. It was determined that following elements were acceptable phosphorous scavengers, in decreasing order of effectiveness: Zr, Ti, Nb, Mo, W, V, Cr. All of these elements are strong carbide formers.

Rare earth elements have been investigated as constituents in low alloy steels to impart resistance to the long term aging embrittlement. For example, Chengjian et al., "Grain Boundary Segregation of Ce, Mo and P and Long term aging embrittlement of Steel," *Chinese Iron and Steel*, Vol. 26, No. 12 (1991); Yang, "Effect of Lanthanum on the Isothermal Embrittlement of P-Doped Ni—Cr Steel," *Proceedings of the International Conference on Rare Earth Development and Applications*, Vol. 2, Academic Press, Inc., San Diego, Calif. (1985); Barrett et al., "The Effect of Sulfur on the Long term aging embrittlement Susceptibility of A Rare Earth-Containing Low Alloy Steel," *Scripta Metallurgica*, Vol. 21 (1987); Seah et al., "Additive Remedy for Temper Brittleness," *Metal Science*, (May 1979); Garcia et al., "Reducing the Susceptibility to Long term aging embrittlement in 2.25Cr-1Mo Steels by Lanthanide Additions," *Properties of High Strength Steels*, ASME, Vol. 114, ASME (1986) studied rare earth elements as constituents in low alloy steels to impart further resistance to the long term aging embrittlement.

However, there is little work to date that studied effects of rare earth elements in high alloy steels, such as but not limited to Fe—12Cr steels. Most work has concentrated on additions of Ce, La, Nd or mischmetall (52% Ce, 24% La, 15% Nd, 7% Pr, 1% Sm, 1% other rare earth elements) in low alloy steels. Ce improved long term aging embrittlement of Fe—1.5Cr-3.5Ni-0.3C through formation of a Ce-P compound; La additions improved resistance to long term aging embrittlement of 2.25Cr-1 Mo and 3.5Ni-Cr-Mo-V steels by decreasing segregation of P and Sn to grain boundaries; and La, Nd and mischmetall may also improve impact properties of 2.25Cr-1 Mo steels. However, there are no known studies with respect to the effects of rare earth elements in high alloy steels.

Segregation of phosphorous is believed to be a large factor in the long term aging embrittlement of high alloy steels, such as Fe—12Cr steels, as embodied in the invention, based on studies done on low alloy steels. Therefore, as embodied in the invention, it is desirable to add at least one constituent to reduce the long term aging embrittlement of high alloy steels, preferably by reducing the segregation of phosphorous, for example either by scavenging or blocking phosphorous from occupying boundary locations.

A high alloy steel, as embodied in the invention, preferably reduces aging embrittlement, for example long term aging embrittlement; at least maintains, and preferably increases yield and creep strengths; and at least maintains, and preferably decreases initial FATT. For example, reducing aging embrittlement is possible in a high alloy steel, by at least one of reducing impurities, reducing alpha prime constituents, and improving tempering resistance. The reduction of impurities can be achieved by at least one of scavenging of impurities, blocking the impurities from occupying boundaries, and reducing at least one, and preferably both of, silicon and aluminum. Each of the reduction of alpha prime and the improving of tempering resistance is accomplished by the modification of at least one of chromium, molybdenum and tungsten.

The at least maintaining, and preferably increasing yield and creep strengths can be achieved in a high alloy steel, as embodied by the invention, by addition of at least one of tungsten, boron and nitrogen. The at least maintaining, and preferably decreasing initial FATT can be achieved in a high alloy steel, as embodied by the invention, by at least one of an addition of at least one of nickel, cobalt, manganese, and copper; the control of grain size, for example with niobium additions and electroslag refining (ESR).

As embodied in one feature of the invention, rare earth elements are incorporated into high alloy steels, such as Fe—12Cr steels, to improve long term aging embrittlement resistance. As embodied in another feature of the invention, boron is been incorporated into high alloy steels, such as Fe—12Cr steels, to prevent segregants from segregating to grain boundaries. As embodied in a further feature of the invention, both rare earth elements and boron have been incorporated into high alloy steels, such as Fe—12Cr steels, to improve long term aging embrittlement resistance. Further, as embodied by the invention, an amount of nickel and cobalt in the high alloy steel, such as but not limited to Fe—12Cr steels, are balanced to optimize aging embrittlement resistance with as tempered toughness.

Rare earth elements tend to be beneficial in reducing long term aging embrittlement as the impurity content of the high alloy steel is lower. The amount of rare earth in high alloy steels, such as Fe—12Cr steels, should be optimized, and the amount will depend on an impurity content of the steels. For example, up to about 0.5 weight percentage of a rare earth element will impart embrittlement resistance Fe—12Cr. Further, a weight percentage of rare earth elements in a 10 range between about 0.1 and about 0.2 is preferred, in high alloy steels, such as Fe—12Cr steels, as embodied in the invention. Still further, a weight percentage of rare earth elements in a range between about 0.1 and about 0.15 is preferred, in high alloy steels, such as Fe—12Cr steels, as embodied in the invention. Furthermore, a weight percentage of about 0.1 is further preferred, in high alloy steels, such as Fe—12Cr steels, as embodied in the invention.

Several rare earth elements have been determined to be effective for long term aging embrittlement resistance of high alloy steels, such as Fe—12Cr. For example, effective rare earth elements, as embodied by the invention, comprise, but are not limited to, yttrium, lanthanum, cerium, praseodymium, neodymium, promethium, samarium, and erbium and combination of these elements.

The composition of the high alloy steels, as embodied in the invention, is set forth in Table 1 as follows. The percentages are given in approximate weight percentage, and the ranges extend from about the first value to about the second value. Also, where a weight value is given in terms of a "max.", this means that the amount of the constituent can approach about the "max." but should not exceed the "max.". Further, in the disclosure, wherever percentage or proportion is stated, reference is to the weight basis unless otherwise expressly noted.

TABLE 1

| | |
|---|---|
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as Ni, Co, Mn, Cu | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Rare Earths | 0.50 max. |
| Iron | Balance |

It has been determined that a high alloy steel composition, similar to that described in Table 1 above, with a further preferred chromium content of 8.00–12.0 percent, by weight, also exhibits an enhanced long term aging embrittlement resistance. Further, it has been also determined that a high alloy steel composition, similar to that described in Table 1 above, with a still more preferred chromium content of 10.50–12.0 percent, by weight, also exhibits an enhanced long term aging embrittlement resistance.

The Austenite stabilizer in the high alloy steels, as embodied by the invention, can comprise known Austenite stabilizers, such as but not limited to nickel, cobalt, copper, magnesium, and combinations of these elements. The amount of Austenite stabilizer in the high alloy steels is preferably in the range between about 0.001 to about 6.0 percent by weight. Preferably, the Austenite stabilizer comprises as much cobalt as possible while minimizing the nickel content. While nickel, as a constituent in the high alloy steel, as embodied in the invention provides desirable toughness properties, cobalt as an Austenite stabilizer, in an amount preferably in amounts as high as possible is preferred since nickel (Ni) may cause undesirable long term aging characteristics. Further, as embodied by the invention, an amount of nickel and cobalt in the high alloy steel, such as but not limited to Fe—12Cr steels, are balanced to optimize aging embrittlement resistance with as tempered toughness.

The high alloy steel, as embodied by the invention, comprises at least one of tungsten and molybdenum. Both tungsten and molybdenum are carbide stabilizers that provide an enhanced solid solution strengthening. In the high alloy steel, as embodied by the invention, the carbide stabilizer is provided in a range between about 0.50 to about 4.00, by weight.

Another manner for mitigating the decrease in fracture toughness of high alloy steels, such as but not limited to, Fe—12Cr steel, as embodied by the invention, is accomplished through an addition of boron to a high alloy steel. Boron, in a high alloy steel, is believed to segregate to grain boundaries occupying many grain boundary sites, and prevents other segregants from accumulating at the grain boundary sites.

Accordingly, as embodied in the invention, boron occupies the grain boundary sites in a high alloy steel and prevents weakening of the high alloy steel at these grain boundary sites. Therefore, addition of boron to a high alloy steel, such as but not limited to Fe—12Cr, reduces long term aging embrittlement, and thus enhances the desirable effects of a high alloy steel.

Moreover, the addition of boron to high alloy steels is not detrimental to grain boundary site strength. Further, the addition of boron, is to some extent, beneficial to an increased cohesive nature of high alloy steels, such as but not limited to Fe—12Cr. Accordingly, boron as a constituent in a high alloy steel, such as but not limited to Fe—12Cr steel, forms a steel that can be used at high operating temperatures for long periods of time. Thus, boron in a high alloy steel, such as but not limited to Fe—12Cr steels, can be used as a replacement for expensive Ni-base alloys in a variety of applications.

Further, the high alloy steel may also contain niobium in amounts up to 0.50 max.

Table 2 lists a composition, in weight percentage, of a boron modified high alloy steel, as embodied by the invention. Boron modified high alloy steels meet strength requirements for use in gas turbines, while mitigating susceptibility to long term aging embrittlement.

TABLE 2

| | |
|---|---|
| Boron | 0.001–0.04 |
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as nickel, cobalt, manganese and copper | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance |

Further, the amount of boron in a high alloy steel, as embodied by the invention, is preferably about 0.005 weight percentage.

It has been determined that a high alloy stainless steel composition, similar to that described in Table 2 above, with a chromium content in a range of about 8.00 to about 12.0 percent, by weight, also exhibits enhanced long term aging embrittlement resistance. Further, it has been determined that a high alloy stainless steel composition, similar to that described in Table 2 above, with a chromium content of 10.5–12.0 percent, by weight, also exhibits enhanced long term aging embrittlement resistance.

The Austenite stabilizer in the high alloy steels, as embodied by the invention, can comprise known Austenite stabilizers, such as but not limited to nickel, cobalt, copper, magnesium, and combinations of these elements. The amount of Austenite stabilizer in the high alloy steels is preferably in the range between about 0.001 to about 6.0 percent by weight. Preferably, the Austenite stabilizer comprises as much cobalt as possible while minimizing the nickel content. While nickel, as a constituent in the high alloy steel, as embodied in the invention provides desirable toughness properties, cobalt as an Austenite stabilizer, in an amount preferably in amounts as high as possible is preferred since nickel (Ni) may cause undesirable long term aging characteristics. Further, as embodied by the invention, an amount of nickel and cobalt in the high alloy steel, such as but not limited to Fe—12Cr steels, are balanced to optimize aging embrittlement resistance with as tempered toughness.

The high alloy steel, as embodied by the invention, comprises at least one of tungsten and molybdenum. Both tungsten and molybdenum are carbide stabilizers that provide an enhanced solid solution strengthening. In the high alloy steel, as embodied by the invention, the carbide stabilizer is provided in a range between about 0.50 to about 4.00, by weight.

Further, in accordance with another aspect of the invention, a high alloy steel, such as but not limited to Fe—12Cr, with additions of both rare earth elements and boron, also exhibits increased long term aging embrittlement resistance. In the high alloy steel including both boron and rare earth elements, the rare earth elements in the high alloy steel scavenge impurities, and boron blocks segregating impurities from occupying grain boundary sites. Thus, a combination of boron and rare earth elements, the advantageous effects thereof in a high alloy steel reduces effects of impurities on long term aging embrittlement.

Further, the high alloy steel may also contain niobium in amounts up to 0.50 max.

Table 3 lists a composition for a rare earth element and boron-doped, stainless steel alloy, as embodied by the invention. This high alloy steel, such as but not limited to Fe—12Cr, comprising additives of rare earth elements and boron, and also meets strength requirements for use in gas turbine applications. The combination of boron and rare earth elements in a high alloy steel also mitigates susceptibility to long term aging embrittlement.

TABLE 3

| | |
|---|---|
| Rare earth | 0.50 max. |
| Boron | 0.001–0.04 |
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as Ni, Co, Mn, Cu | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |

TABLE 3-continued

| | |
|---|---|
| Aluminum | 0.001–0.025 |
| Arsenic | 0.0060 max. |
| Antimony | 0.0030 max. |
| Tin | 0.0050 max. |
| Iron | Balance |

Further, the amount of boron in a high alloy steel as embodied by the invention, is preferably about 0.005 weight percentage.

It has been determined that a high alloy stainless steel composition, similar to that described in Table 3 above, with a further preferred chromium content of 8.00–12.0 percent, by weight, also exhibits an enhanced long term aging embrittlement resistance. Further, it has been also determined that a high alloy stainless steel composition, similar to that described in Table 3 above, with a still more preferred chromium content of 10.50–12.0 percent, by weight, also exhibits an enhanced long term aging embrittlement resistance.

The high alloy steel, as embodied by the invention, comprises at least one of tungsten and molybdenum. Both tungsten and molybdenum are carbide stabilizers that provide an enhances solid solution strengthening. In the high alloy steel, as embodied by the invention, the carbide stabilizer is provided in a range between about 0.50 and 4.00, by weight.

The Austenite stabilizer in the high alloy steels, as embodied by the invention, can comprise known Austenite stabilizers, such as but not limited to nickel, cobalt, copper, magnesium, and combinations of these elements. The amount of Austenite stabilizer in the high alloy steels is preferably in the range between about 0.001 to about 5.0 percent by weight. Preferably, the Austenite stabilizer is present as cobalt, where the cobalt is provided in the high alloy steel in a the range between about 0.001 to about 5.0 percent by weight. Cobalt, as an Austenite stabilizer is preferred since other Austenite stabilizers, such as nickel (Ni) while effective as an Austenite stabilizer, may cause undesirable long term aging characteristics.

Further, the high alloy steel may also contain niobium in amounts up to 0.50 max.

Further, as embodied by the invention, an amount of nickel and cobalt in the high alloy steel, such as but not limited to Fe—12Cr steels, are balanced to optimize aging embrittlement resistance with as tempered toughness. While nickel, as a constituent in the high alloy steel, as embodied in the invention provides desirable toughness properties, cobalt as an Austenite stabilizer, in an amount preferably in amounts as high as possible is preferred since nickel (Ni) may cause undesirable long term aging characteristics.

The high alloy steel, as embodied by the invention, comprises at least one of tungsten and molybdenum. Both tungsten and molybdenum are carbide stabilizers that provide an enhanced solid solution strengthening. In the high alloy steel, as embodied by the invention, the carbide stabilizer is provided in a range between about 0.50 to about 4.00, by weight.

The addition of further constituents in a controlled weight percentage to a high alloy steel will enhance several properties of a high alloy steel, such as but not limited to Fe—12Cr. These constituents are added in amounts so as not to impair the beneficial aspects of the addition of at least one of rare earth elements and boron. However, these constituents are often balanced with these elements to achieve optimum properties in the high alloy steel. These additional constituents are discussed below. The additional constituents can be added to a high alloy steel, as embodied in the invention, for example as set forth in any one of Tables 1, 2, and 3. The additional constituents will be discussed in further detail below, with preferred ranges and amounts of the constituents, in a high ally steel, as embodied by the invention.

Corrosion resistance properties of a high alloy steel, as embodied by the invention, are enhanced by the chromium in the high alloy steel, as well as the additional rare earth elements to the high alloy steel. A preferred level of the chromium is in a range between about 8.0 to about 13.0 and further preferably between about 10.5 and 12.0.

The rare earth element in the high alloy steel, as embodied in the invention, can take the form of any one of the above listed elements or combinations of the elements, with a maximum weight percentage of about 0.5. However, it is preferred the that the rare earth be one of lanthanum and yttrium, and in an amount in a range between about 0.01 to about 0.3 weight percentage, preferably in a range between about 0.1 and 0.15 and still preferably about 0.1 weight percentage.

Toughness properties of a high alloy steel, as embodied by the invention, are enhanced in a low initial FATT high alloy steel, wherein a low initial FATT high alloy steel includes at least one of low amounts of inclusions; relatively fine martensite structure; and a controlled grain size and structure.

The low inclusions in the high alloy steel, as embodied by the invention, can be provided by an electroslag remelting (ESR). The fine grain structure can be achieved by controlling a niobium content of a high alloy steel in a range between about 0.01 to about 0.2 weight percentage, and preferably about 0.05 weight percentage.

Also, it is believed that a relatively fine martensite grain structure can be achieved in an initial high alloy steel by at least one of a low FATT and providing a decreasing weight percent of nickel, copper, manganese and cobalt, with the total weight percent of each of these constituents being less than about 6.0. The high alloy steel, as embodied by the invention, with a fine grain structure has the decreasing weight percentage of nickel, copper, manganese and cobalt in that order. For example, a high alloy steel, as embodied by the invention, comprises nickel in a range between about 0.1 to about 4.0 and cobalt in a range between about 0.5 to about 6.0, by weight. Further, a high alloy steel, as embodied by the invention, preferably comprises nickel in a range between about 0.1 to about 2.0 and cobalt in a range between about 1.0 to about 4.0, by weight. As discussed above, the nickel amount is kept to a minimum to prevent undesirable long term aging effects, while maintaining the desirable toughness effects of nickel in a high alloy steel.

The toughness of a high alloy steel, as embodied by the invention, is also enhanced after aging by at least one of the controlling of a formation of segregants and the controlling of the formation of second phases. For example, a "super clean" high alloy steel is achieved, in accordance with the invention, by reducing segregants. This reduction of segregants is achieved by providing the high alloy steels above, for example but not limited to Fe—12C,r with relatively low amounts of silicon, aluminum, nickel, and manganese, as well as very low amounts of sulfur, phosphorous, arsenic, tin and antimony.

Also, the formation of segregants is also controlled by the addition of rare earth elements. For example, an addition of lanthanum as a rare earth element constituent in a high alloy steel, such as but not limited to Fe—12Cr, reduces the formation of segregants. The lanthanum is provided in the high alloy steel, as embodied by the invention, in a range between about 0.01 to about 0.5, and preferably in a range between about 0.1 and 0.3, by weight percentage.

Further, the formation of segregants is also controlled by the addition of interstitials of at least one of boron and nitrogen as a constituent of a high alloy steel, such as but not limited to Fe—12Cr. The amount of nitrogen should preferably be less than about 0.060 and preferably about 0.040 weight percentage. The boron amount in a high alloy steel, as embodied by the invention, is in an range between about 0.001 to about 0.02, and preferably about 0.005 weight percent, so as to effectively control The nitrogen amount in a high alloy steel, as embodied by the invention, is less than about 0.06, and preferably about 0.04 weight percentage, so as to effectively control segregants.

The controlling of the formation of second phases to increase toughness in a high alloy steel, such as but not limited to Fe—12Cr, can be achieved by stabilizing precipitates of at least one of molybdenum and tungsten. For optimal creep resistance, it has been determined that the amount of molybdenum+½ the amount of tungsten should equal about 1.5. Also, the controlling of the formation of second phases in a high alloy steel, such as but not limited to Fe—12Cr, can be achieved by at least one reducing any alpha prime phases in the high ally steel, in conjunction with low amounts of chromium and molybdenum impurities.

The creep strength characteristics of a high alloy steel, such as but not limited to Fe—12Cr, can be maintained and possibly improved upon by at least one of providing a solid solution in the high alloy steel and controlling precipitates in the high alloy steel, as embodied by the invention, For example, the solid solution is controlled by achieving an optimum balance of molybdenum and tungsten, so that 1.5 is less than or equal to Mo+½ W, i.e., $1.5 \geqq Mo+\frac{1}{2} W$. This relationship between molybdenum and tungsten is also reflective of the relationship of tungsten and molybdenum for reducing second phases, as discussed above.

Further, controlling of formation of solid solutions to maintain and possibly enhance creep strength can be provided in a high alloy steel, such as but not limited to Fe—12Cr, by optimizing a balance between boron and nitrogen additions in a high alloy steel. For example, in a high alloy steel as embodied by the invention, to maintain and possibly enhance creep strength properties, the boron amount is provided in a range between about 0.001 to about 0.02 and preferably about 0.005 weight percent and the tungsten amount is provided in a range less that about 0.060 and preferably about 0.040 weight percentage.

Also, the controlling of the formation of solid solutions to increase both yield and tensile strength, as well as creep strength, in a high alloy steel, such as but not limited to Fe—12Cr, can be achieved by at least one of optimizing a balance between boron and nitrogen in the high alloy steel, as embodied by the invention, optimizing a balance between niobium and vanadium in the high alloy steel, controlling an amount of cobalt in the high alloy steel, such as but not limited to Fe—12Cr, to a range between about 0.5 to about 6.0 weight percent, and preferably in a range between about 1.0 to about 4.0 weight percentage.

Further, optimizing a relationship between niobium and vanadium, in a high alloy steel as embodied in the invention, control precipitates and thus enhances creep strength. Accordingly, it has been determined that a maximum amount of niobium in a high alloy steel as embodied in the invention is about 0.050 weight percentage.

Moreover, the yield and tensile strengths of the high alloy steel, as embodied by the invention, such as but not limited to Fe—12Cr, are enhances by controlling the solid solution formation in the high alloy steel. Also, as is known, a heat treatment of the high alloy steel will increase the yield and tensile strengths of steels, including those embodied by the invention.

Furthermore, in all the above examples of constituents for a high alloy steel, as embodied in the invention, the high alloy steel should preferably not contain more than about 0.050% manganese, 0.050% silicon, 0.0020% phosphorus, 0.0010% tin, 0.0005% antimony, 0.0030% arsenic. Thus, the high alloy steel is a "super clean" steel and achieves enhanced toughness properties.

As embodied in the invention, a preferred composition of a high alloy steel, for example as set forth in Table 3 provides a steel with a composition, in weight percentage, as follows:

0.12C - 11Cr - 1.5W -0.5Mo -2.0Ni - 1.0Co - 0.2V - 0.05Nb - 0.005B - 0.04N - 0.10La/Y

While the embodiments described herein are preferred, it will be appreciated from the specification that various combinations of elements, variations or improvements therein may be made by those skilled in the are that art within the scope of the invention.

We claim:

1. A cobalt and rare earth containing steel consisting essentially of, by weight percent:

| | |
|---|---|
| Carbon | 0.08–0.15 |
| Silicon | 0.01–0.10 |
| Chromium | 8.00–13.00 |
| At least one of Tungsten and Molybdenum | 0.50–4.00 |
| Cobalt and at least one | 0.001–6.00 |
| Austenite stabilizer selected from the group consisting of: such as Nickel, Manganese and Copper | |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Rare Earth | 0.50 max. |
| Iron | Balance. |

2. The steel according to claim 1, comprising not in excess of 0.050 manganese, 0.050 silicon, 0.0020 phosphorus, 0.0020 tin, 0.0010 antimony, 0.0030 arsenic weight percentage.

3. The steel according to claim 1, comprising not in excess of 0.050 manganese, 0.050 silicon, 0.0050 phosphorus, 0.0040 sulfur, 0.0050 tin, 0.0030 antimony, 0.0060 arsenic weight percentage.

4. The steel according to claim 1, wherein the alloy exhibits enhanced low brittle to ductile transition temperatures and enhanced hardening characteristics, and consequently having utility in gas turbine, steam turbine and jet engine applications.

5. The steel according to claim 1, the rare earth is selected from the group consisting of yttrium, lanthanum, cerium, praseodymium, neodymium, promethium, samarium, erbium and combinations of these elements.

6. The steel according to claim 1, wherein the amount of chromium is in a range between about 8.0 to about 12.0 weight percentage.

7. The steel according to claim 1, wherein the amount of chromium is in a range between about 10.5 to about 12.0 weight percentage.

8. The steel according to claim 1, wherein the amount of rare earth is in a range between about 0.1 to about 0.2 weight percentage.

9. The steel according to claim 1, wherein the amount of rare earth is in a range between about 0.1 to about 0.15 weight percentage.

10. The steel according to claim 1, wherein the amount of rare earth is about 0.1 weight percentage.

11. The steel according to claim 1, where the cobalt and at least one Austenite stabilizer comprises nickel, cobalt, copper, magnesium, and combinations of these elements.

12. The steel according to claim 1, where the cobalt and at least one Austenite stabilizer is provided in a range between about 0.001 to about 5.0 weight percentage.

13. The steel according to claim 1, further comprising nitrogen, the amount of nitrogen being less than about 0.060 weight percentage.

14. The steel according to claim 1, further comprising nitrogen, the amount of nitrogen being less than about 0.040 weight percent.

15. The steel according to claim 1, further comprising tungsten, the amount of tungsten being related to molybdenum, so that a weight percent of molybdenum plus ½ a weight percent of tungsten is equal to no less than 1.5.

16. The steel according to claim 1, wherein an amount of rare earth and chromium are balanced with respect to each other.

17. The steel according to claim 1, where the cobalt and the at least one Austenite stabilizer comprises nickel and cobalt.

18. The steel according to claim 1, further comprising niobium in amounts up to 0.50 max weight percentage.

19. A boron and cobalt containing steel consisting essentially of, by weight percentage:

| | |
|---|---|
| Boron | 0.001–0.04 |
| Carbon | 0.08–0.15 |
| Silicon | 0.01–0.10 |
| Chromium | 8.00–13.00 |
| At least one of | |
| Tungsten and Molybdenum | 0.50–4.00 |
| Cobalt and [A] at least one Austenite stabilizer, [such as] selected from the group consisting of: Nickel, Cobalt, Manganese and Copper | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance. |

wherein amounts of cobalt, nickel manganese and copper are related with an amount of cobalt being generally less than an amount of manganese, nickel; which is generally less than an amount of copper.

20. The steel according to claim 19, comprising not in excess of 0.050 manganese, 0.050 silicon, 0.0020 phosphorus, 0.0020 tin, 0.0010 antimony, 0.0030 arsenic weight percentage.

21. The steel according to of claim 19, comprising not in excess of 0.050 manganese, 0.050 silicon, 0.0050 phosphorus, 0.0040 sulfur, 0.0050 tin, 0.0030 antimony, 0.0060 arsenic weight percentage.

22. The steel according to claim 19, wherein the steel exhibits enhanced low brittle to ductile transition temperatures and enhanced hardening characteristics and consequently having utility in gas turbine, steam turbine and jet engine applications.

23. The steel according to claim 19, wherein the amount of chromium is in a range between about 8.0 to about 12.0 weight percent.

24. The steel according to claim 19, wherein the amount of chromium is in a range between about 10.5 to about 12.0 weight percent.

25. The steel according to claim 19, wherein the amount of boron is about 0.005 weight percent.

26. The steel according to claim 19, wherein the cobalt and the at least one Austenite stabilizer comprises nickel, cobalt, copper, magnesium, and combinations of these elements.

27. The steel according to claim 19, where the cobalt and the at least one Austenite stabilizer is provided in a range between about 0.001 to about 5.0 weight percentage.

28. The steel according to claim 19, further comprising nitrogen, the amount of nitrogen being less than about 0.060 weight percent.

29. The steel according to claim 19, further comprising nitrogen, the amount of nitrogen being less than about 0.040 weight percent.

30. The steel according to claim 19, further comprising tungsten, the amount of tungsten being related to molybdenum, so that 1.5 is less than or equal to the weight percent of molybdenum and ½ the weight percent of tungsten.

31. The steel according to claim 19, where the Austenite stabilizer, such as nickel, cobalt, manganese and copper, comprises nickel and cobalt.

32. The steel according to claim 19, further comprising niobium in amounts up to 0.50 max weight percentage.

33. A boron, cobalt, and rare earth containing steel consisting essentially of, in weight percent:

| | |
|---|---|
| Boron | 0.001–0.04 |
| Carbon | 0.08–0.15 |
| Silicon | 0.01–0.10 |
| Chromium | 8.00–13.00 |
| At least one of | |
| Tungsten and Molybdenum | 0.50–4.00 |
| Cobalt and [A] at least one Austenite stabilizer, [such as] selected from the group consisting of: Nickel, Cobalt, Manganese and Copper | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Rare [Earths] Earth | 0.50 max. |
| Iron | Balance. |

34. The steel according to claim 33, comprising not in excess of 0.050 manganese, 0.050 silicon, 0.0020 phosphorus, 0.0020 tin, 0.0010 antimony, 0.0030 arsenic weight percentage.

35. The steel according to of claim 33, comprising not in excess of 0.050 manganese, 0.050 silicon, 0.0050 phosphorus, 0.0040 sulfur, 0.0050 tin, 0.0030 antimony, 0.0060 arsenic weight percentage.

36. The steel according to claim 33, wherein the steel exhibits enhanced low brittle to ductile transition temperatures and enhanced hardening characteristics and consequently having utility in gas turbine, steam turbine and jet engine applications.

37. The steel according to claim 33, the rare earth is selected form the group consisting of yttrium, lanthanum, cerium, praseodymium, neodymium, promethium, samarium, and erbium and combinations of these elements.

38. The steel according to claim 33, wherein the amount of chromium is in a range between about 8.0 to about 12.0 weight percent.

39. The steel according to claim 33, wherein the amount of chromium is in a range between about 10.5 to about 12.0 weight percent.

40. The steel according to claim 33, wherein the amount of boron is about 0.005 weight percent.

41. The steel according to claim 33, wherein the amount of rare earth is in a range between about 0.1 to about 0.2 weight percentage.

42. The steel according to claim 33, wherein the amount of rare earth is about 0.1 weight percent.

43. The steel according to claim 31 where the cobalt and the at least one Austenite stabilizer comprises nickel, cobalt, copper, magnesium, and combinations of these elements.

44. The steel according to claim 33, where the cobalt and the at least one Austenite stabilizer is provided in a range between about 0.001 to about 5.0 weight percentage.

45. The steel according to claim 33, further comprising nitrogen, the amount of nitrogen being less than about 0.060 weight percent.

46. The steel according to claim 33, further comprising nitrogen, the amount of nitrogen being less than about 0.040 weight percent.

47. The steel according to claim 33, further comprising tungsten, the amount of tungsten being related to molybdenum, so that 1.5 is less than or equal to Mo+½ W.

48. The steel according to claim 33, wherein the amount of rare earth and chromium are balanced with respect to each other.

49. The steel according to claim 33, where the cobalt and the at least one Austenite stabilizer comprises nickel and cobalt.

50. The steel according to claim 33, further comprising niobium, the niobium provided in amounts up to 0.50 max.

51. The steel according to claim 50, wherein the steel comprises a composition:

0.12C - 11Cr - 1.5W - 0.5Mo - 2.0Ni -1.0Co - 0.2V - 0.05Nb - 0.005B - 0.04N - 0.10 of one of La and Y.

52. The steel according to claim 1, further comprising niobium, the niobium provided in amounts up to 0.50 max.

53. The steel according to claim 19, further comprising niobium, the niobium provided in amounts up to 0.50 max.

* * * * *